US005581992A

United States Patent [19]

Borouchov

[11] Patent Number: 5,581,992

[45] Date of Patent: Dec. 10, 1996

[54] METHOD AND APPARATUS FOR IMPARTING REFLECTIVE SURFACES TO ITEMS OF JEWELRY

[76] Inventor: Israel Borouchov, 1801 50th St. #10D, Brooklyn, N.Y. 11204

[21] Appl. No.: 559,035

[22] Filed: Nov. 15, 1995

[51] Int. Cl.[6] ..... B21L 15/00

[52] U.S. Cl. ..... 59/29; 59/35.1

[58] Field of Search ..... 59/16, 17, 20, 59/35.1, 80, 29

[56] References Cited

U.S. PATENT DOCUMENTS

| | | | |
|---|---|---|---|
| 4,679,391 | 7/1987 | Tizzi | 59/35.1 |
| 5,125,225 | 6/1992 | Strobel . | |
| 5,129,220 | 7/1992 | Strobel . | |
| 5,303,540 | 4/1994 | Rozenwasser | 59/35.1 |
| 5,353,584 | 10/1994 | Strobel et al. . | |
| 5,412,935 | 5/1995 | Rozenwasser | 59/35.1 |
| 5,471,830 | 12/1995 | Gonzales | 59/35.1 |

*Primary Examiner*—David Jones
*Attorney, Agent, or Firm*—Lackenbach Siegel Marzullo Aronson & Greenspan, P.C.

[57] ABSTRACT

A method is disclosed for modifying the surface of an item of jewelry having a cylindrical outer surface. The item of jewelry is advanced axially successively through a cutting station at which a cutting tool provided with one or more cutting elements each having a cutting tip are rotated relative to the item of jewelry generally about an axes coaxial with the elongate item of jewelry. The cutting tips project beyond the cylindrical surface of the item of jewelry and, therefore, scratch, cut or displace the material from which the jewelry is made to generate a plurality of reflecting surfaces in the case of a non continuous cylindrical surface and one or more cylindrical grooves in the case where the item of jewelry has a cylindrical surface. By controlling the linear velocity of advancement of the item of jewelry through the cutting station and the relative angular velocities of the item of jewelry relative to the cutting elements different quantities and patterns of reflecting surfaces can be provided. The method produces items of jewelry which have enhanced sparkling or glittering properties.

20 Claims, 2 Drawing Sheets

20
10
4a
A'
14
16
14b
S
A
12
24
12S
22
16
26

3
14
20

12
16
12S
3

FIG. 3
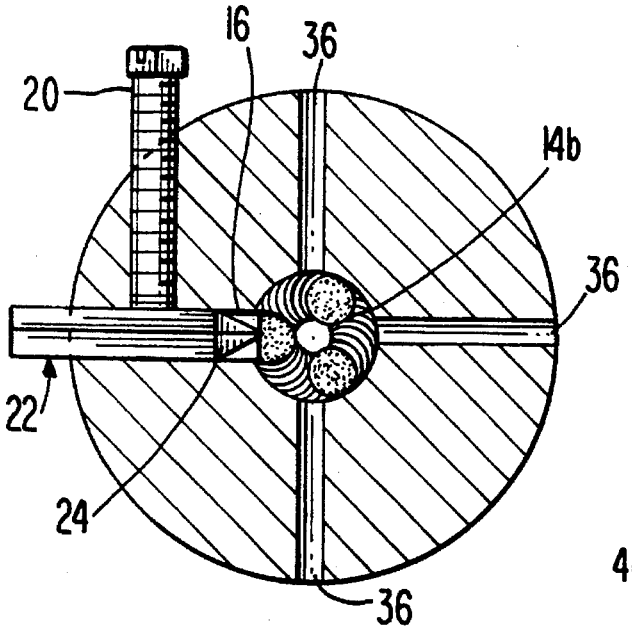
FIG. 4
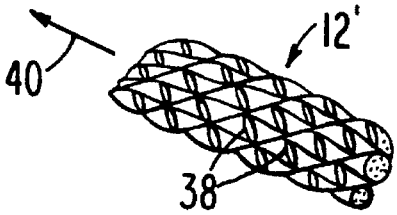
FIG. 5
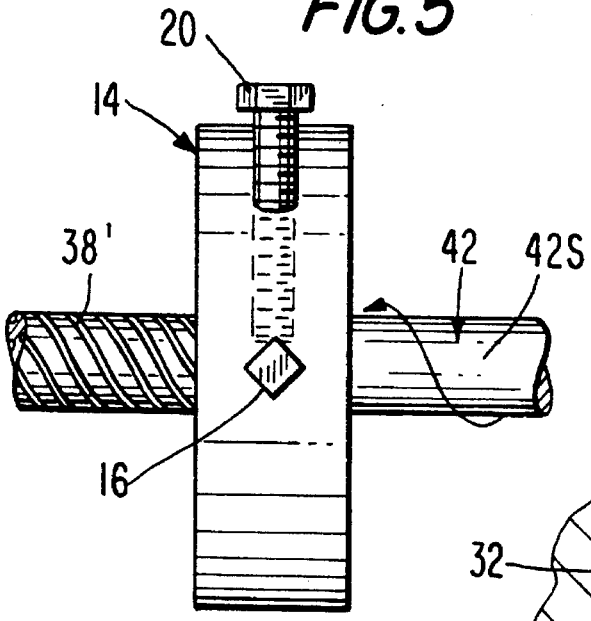
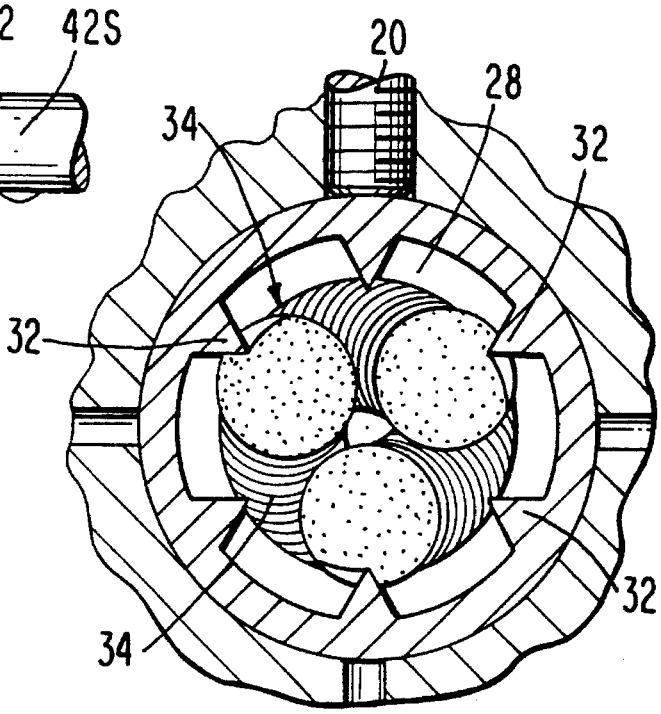
FIG. 6

METHOD AND APPARATUS FOR IMPARTING REFLECTIVE SURFACES TO ITEMS OF JEWELRY

CROSS REFERENCE TO DISCLOSURE DOCUMENT

This application corresponds to Disclosure Document No. 358511 filed on Jul. 29, 1994.

BACKGROUND OF THE INVENTION

1. Field of the Invention

This invention generally relates to surface treatments of materials, and more particularly to a method of imparting reflective surfaces to items of jewelry, and jewelry resulting from processing in accordance with the method.

2. Description of the Prior Art

It is frequently an objective of jewelry makers to enhance or increase the degree by which an item of jewelry sparkles or glitters. Indeed, it has become both an art and a science to maximize light reflections and, thereby, the brilliance or fire of diamonds. The desire to optimize light reflections has extended beyond precious gems. Items of jewelry, such as necklaces, bracelets, earrings and the like made from precious metals, have also in many instances been designed to increase reflections of light in order to enhance the aesthetic appearance of these items of jewelry by making them shimmer as light is reflected from them. By way of example, in U.S. Pat. Nos. 5,125,225; 5,129,220 and 5,353,584 a method is disclosed for imparting flat surfaces onto hollow rope chains in order to provide reflecting surfaces. Similar techniques had previously been used in connection with solid rope chains. While some techniques have been performed manually or by hand, the method disclosed in the aforementioned patents represent an effort to provide such surface treatments on the surfaces of jewelry items on a more automated, mass production basis. Clearly, the purpose of such methods is to enhance the aesthetic appearance and, therefore, the value of the resulting jewelry while maintaining costs down to a minimum.

Typically, the surfaces of the jewelry are modified in order to provide one or more reflective surfaces which add sparkle and glitter to the jewelry. One example is the passage of a generally round tubular shaped item, such as a rope chain, through one or more forming dies in which the chain is essentially cut along four sides to form a rope chain which has a generally square cross-sectional configuration. This is achieved by cutting off the outer peripheries or peaks of the turns or links of the chain, thereby providing flat surfaces that reflect light more than did the original curved or rounded surfaces. This tends to reflect more focused light by reducing scattering or dispersion. Passage of the chains, such as rope chains, through such a dye or dies is relatively inexpensive and automated procedures allow the chains to be given a new and distinctive appearance that render the chains more aesthetic by imparting a sparkle or glitter to the chain which did not exist before. However, with this process the cross section of the chain becomes, square as aforementioned. Additionally, because the dies tend to shave off material from the surface of the jewelry, there is some loss in precious metal. Also, the removal of materials in any appreciable amount can weaken the structural integrity of the jewelry and weaken it. With regard to a rope chain, the weakening of the links may result in the links opening and the chain becoming damaged. Furthermore, this technique has the additional disadvantage that it requires the production of a die which is a relatively fixed in configuration and, therefore, limits the number or extent of the reflecting surfaces that can be produced for a given diameter chain or other item of jewelry. This restricts the versatility of the apparatus and the range of product designs that can be achieved with a given die configuration.

SUMMARY OF THE INVENTION

Accordingly, it is not an object of the present invention to provide a method of modifying the surface treatment, particularly of a item of jewelry, which does not possess the disadvantages inherent in prior art methods.

It is another object of the present invention to provide a method as in the previous object, which is economical and which can be used efficiently.

It is still another object of the present invention to provide a method as in the previous object, which can be readily adapted to mass production techniques of jewelry.

It is yet another object of the present invention to provide a method of the type under discussion which provides a large range of flexibility in the modification of the surface treatment that can be applied.

It is a further object of the present invention to provide a method as aforementioned which can provide different shapes and sizes of reflecting surfaces with a given manufacturing setup.

It is still a further object of the present invention to provide items of jewelry having a cylindrical outer surface which is produced in accordance the method of the invention.

In order to achieve the above objects as well as others which will become apparent hereafter, a method in accordance with the present invention for importing reflective surfaces to the surface of an elongate item of jewelry having a generally external cylindrical surface defining a jewelry axis comprises the step of advancing successive portions of the time of jewelry to position th jewelry axis associated with each portion along an axis of a station at which reflecting surfaces are to be imparted to the portion of the item of jewelry. Reflecting surfaces are imparted to the cylindrical surface of the portion of the jewelry at the station, and the portions at the station are rotated relative to the surface producing means at the station to provide reflective surfaces about the cylindrical extent of the cylindrical surface as the item of jewelry is advanced through such station.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 3 is a cross sectional view of the tool illustrated in FIG. 2, taken along line 3—3, showing the details of how the cutting element within the tool is secured and how the cutting tip thereof imparts reflecting surfaces unto the external surfaces of the strands making up the rope chain;

FIG. 4 is a short section of a rope chain, in perspective, illustrating the reflecting cuts or surfaces of the type that can be imparted by use of the cutting tool illustrated in FIGS. 1–3;

FIG. 5 is similar to FIG. 2 but showing the use of the cutting tool and method to impart reflecting surfaces forming a part of a continuous groove formed in a solid cylindrical surface; and FIG. 6 is a view generally similar to FIG. 3, but illustrating an alternate embodiment of a cutting tool which includes a plurality of cutting tips which operate simultaneously on the cylindrical surface being treated.

DESCRIPTION OF THE PREFERRED EMBODIMENT

Figure 1:
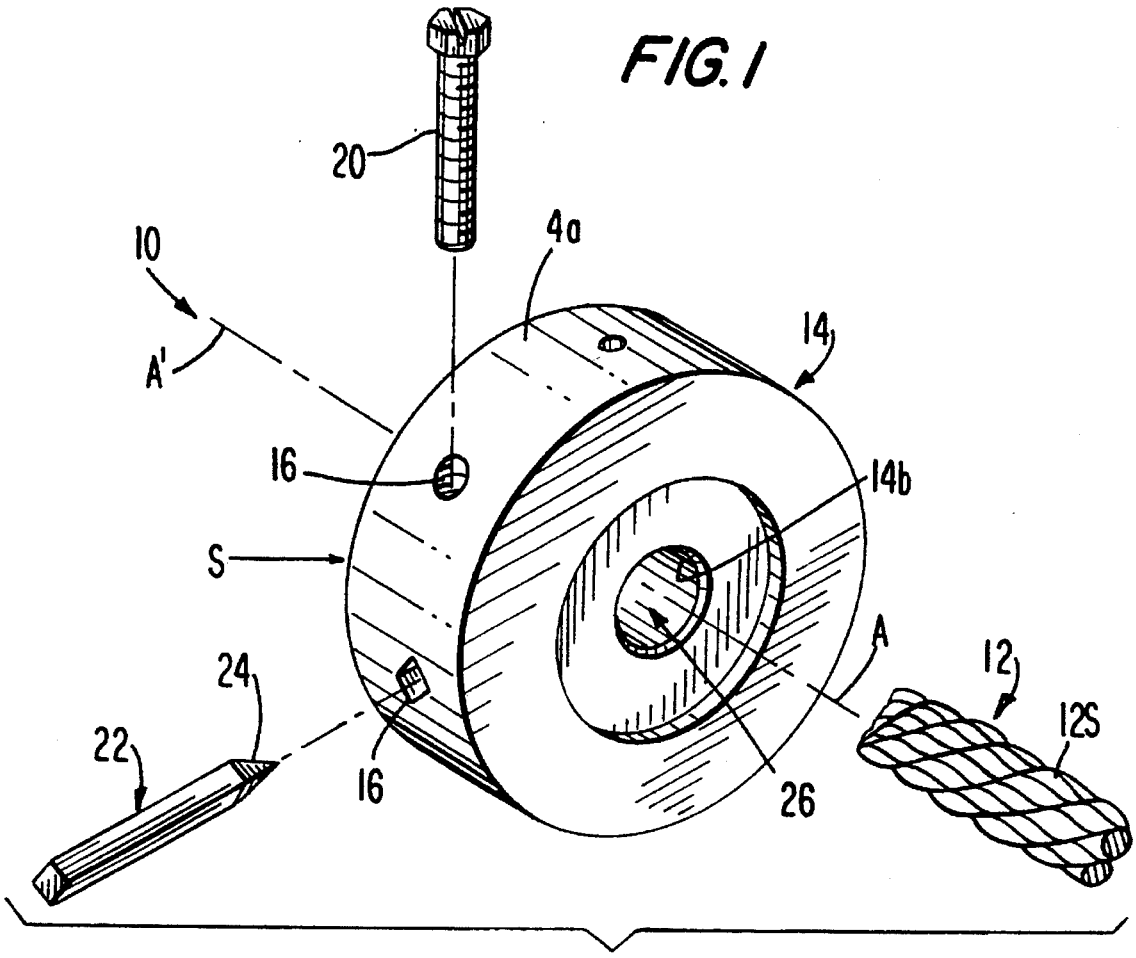
FIG. 1 is an exploded perspective view of the cutting tool or jig in accordance with the present invention for imparting reflecting surfaces on a surface of an item of jewelry having a cylindrical outer surface, such as a rope chain, showing the cutting element and the fastener for securing the same removed from the tool.
Figure 2:
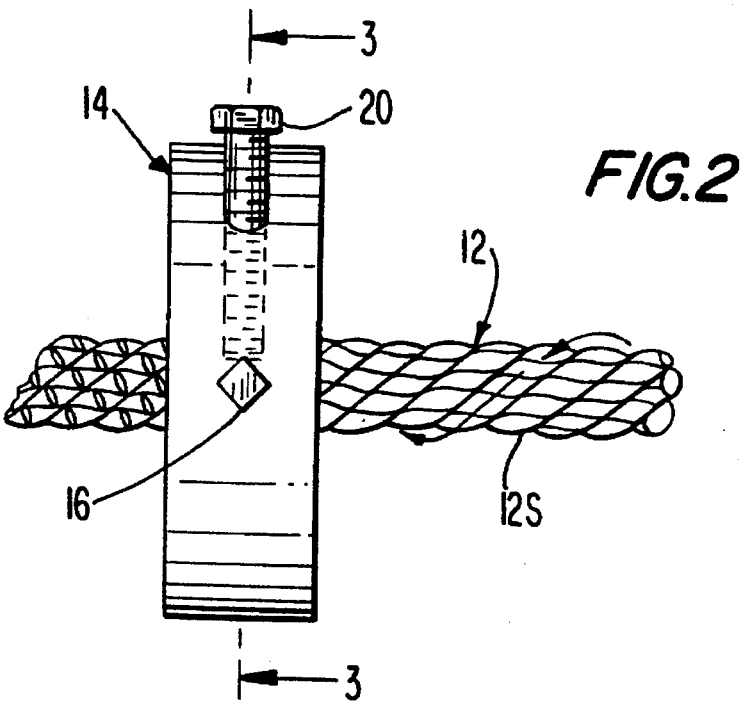
FIG. 2 is a side elevational view of the cutting tool shown in FIG. 1, illustrating the manner in which a rope chain extends through the tool and the manner in which the cutting tool is secured therein during normal operation of the tool.

Referring now more specifically to the figures, in which identical or similar parts are designated with the same reference numerals throughout, and first referring to FIG. 1, a cutting tool in accordance with the present invention is designated by the reference numeral 10.

The cutting tool 10 in accordance with the present invention is intended to impart reflective surfaces to the surface of an elongate item of jewelry having a generally external cylindrical surface, such as the illustrated rope chain 12. While the rope chain does not strictly define a continuous uniform cylindrical outer surface, the external surface of the individual twisted strands generally define such a cylindrical surface and, it will be clear to those skilled in the art, that the method of the present invention can be equally applied to any section of material which defines a generally cylindrical lumen about a given axis A. Because the rope chain may be a long continuous chain, the only portion that is shown, for purposes of the description, is that portion of the rope chain which approaches and is positioned or disposed at or proximate to a processing station S where the cutting tool 10 is located. Successive portions of the rope chain, which are upstream, and not shown in FIG. 1, are ultimately brought to the processing station S at which time the axes of those portions will likewise be oriented as illustrated in FIG. 1.

One example of the cutting tool 10 illustrated in FIG. 1 includes a generally solid annular ring 14 which is provided with a radial bore or elongate cavity 16 (as best shown in FIG. 3) which extends from the exterior surface 14*a* through the entire radial thickness of the annular ring 14 to the internal surface 14*b* and is generally oriented in a radial direction, passing through the center or axis A' of the cutting tool 10. The axis A' may also be denominated the machine axis or axis of the cutting tool 10.

A second cylindrical bore 18 is provided which is arranged in a direction generally orthogonal or perpendicular to the bore 16, being shown provided approximately midway between the internal surface 14*b* and the external surface 14*a* of the annular ring 14. Again, as best shown in FIG. 3. The first elongate bored 16 may or may not be provided with an internal thread. However, the second bore 18 is provided with an internal screw thread for receiving a retaining fastener 20. A cutting element 22 dimentioned to be received within the first bore 16 with little clearance can thereby be fixedly secured within the bore 16 by the action of the locking fastener or screw 20. If the cutting element 22 is provided with an external screw thread it can be advanced or retracted in relation to the bore 16 by rotation. With the embodiment illustrated, the cutting element 22 is simply slidably moved radially inwardly or outwardly to any desired position, at which time it is locked in place by the fastening element or screw 20.

The cutting element 22 includes an appropriate cutting portion 24 which may be shaped in any desired manner in order to produce desired reflecting surfaces. Thus, the cutting portion may be a cutting tip which is conical or in the shape of a pyramid or any other shape to form flat surfaces, such as V-shaped grooves, on the surface of the item of jewelry being processed. Similarly, the cutting tip 24 can be in the form of a flat cutting edge or a blunt tip to produce desired, normally flat, reflecting surfaces. Therefore, the specific tip configuration is not critical in accordance with the present invention and different surface treatments and sizes and shapes of reflecting surfaces can be formed by modifying the shapes, configurations and sizes of the cutting tips.

As also illustrated in FIGS. 1 and 3, the annular ring 14 has a central axial bore or cavity 26 which is dimentioned to substantially correspond to the external dimensions of the rope chain 12 or other item of jewelry whose surface is to be modified by imparting of reflecting surfaces. However, in accordance with the invention, there is advantageously at least a small clearance (not shown) between the external surface 12S of the item of jewelry or other item to be processed and the internal surface 14*b* of the annular ring 14 so that a relative rotation may be imparted between the annular ring 14, on the one hand, and the item of jewelry 12 to be processed, on the other hand. Therefore, while relative rotation between the annular ring 14 of the cutting tool 10 and the item of jewelry 12 is an important element of the method, by appropriately selecting the relative diameters of the cylindrical surfaces 12*s* and 14*b* this may be achieved without unnecessary friction or contact between these facing cylindrical surfaces other than the contact between the external surface 12*s* of the item of jewelry and the cutting tips 24 of the cutting elements. In FIG. 3, although a clearance is not shown, a clearance is provided, even if the clearance is relatively small. In FIG. 6, in which a variant form of the cutting element is illustrated a greater clearance 28 is shown. Thus, in FIG. 6, instead of providing only a single cutting element, there is provided a cylindrical cutting element 30 on which there is formed six internal inwardly projecting cutting tips 32 equally angularly spaced from each other about the internal surface of the cutting element 30. When acting on a rope chain having three ropes as illustrated in FIG. 6, only three of the cutting tips are operative at any one time, the others being positioned within recesses 34 by the stranding of three separate ropes each formed of a plurality of strands.

As best shown in FIGS. 1, 3 and 6, there is advantageously provided at least one additional bore 36 which communicates between the central axial bore 26 of the annular ring 14 an the external surface 14*a* thereof. The purpose of these additional radial bores 36 is to provide passageways through which cuttings and dust can be removed to prevent accumulations thereof within the cutting tool 10 which might interfere with the process and operations.

Referring to FIG. 4, a section of rope chain 12' is illustrated, showing one form of surface treatment achievable with the present invention. The reflective surfaces 38 which have been imparted are generally V-shaped grooves imparted by a conical or trapezoidal cutting tip 24 when relative rotation is provided about the axes A, A' between the item of jewelry and the cutting element 10. It should be clear to those skilled in the art that such relative rotation can be imparted either by rotating the cutting tool 10 and fixing the chain 12 from rotating about its axis, by rotating the chain 12 about its axis A while maintaining the cutting tool 10 fixed in place, or, in fact, by rotating both the portion of the chain at the cutting station S at an angular velocity different than that of the cutting tool 10. The frequency or number of reflecting surfaces 38 that are cut will clearly be a function of the relative angular speed at which such relative rotation is provided as well as the linear velocity along axial direction 40 (FIG. 4) at which the chain is advanced through the cutting tool 10. The higher the linear velocity for a given relative rotational speed, the fewer the number of reflecting surfaces that will be imparted and the more axially they will be oriented in relation to the axis A' of rotation. The slower the linear speed for a given relative angular rotation the more cutting surfaces 38 that will be imparted and the more they will be oriented circumferentially about the cylindrical surface of the item of jewelry along directions approaching perpendicular directions in relation to the axis A, A' of rotation.

In FIG. 5, an item 42 is illustrated having a substantially solid external cylindrical surface 42*s*. This might be, for example, a tubular gold member which is ultimately fashioned into an item of jewelry such as an earring. When the external is solid, as shown in FIG. 5, a continuous groove 38' is imparted as has been described since there is contact between the cutting tip 24 and the item 42 being processed. This can, however, be modified by periodically separating the cutting tip 24 from the continuous cylindrical surface 42*s*. This can be done, for example, by the use of a suitable cam mechanism (not shown) which moves the cutting element 22 inwardly and outwardly during linear advancement of the tube 42 through the cutting tool 10. While such a caming arrangement is not illustrated, it will be readily evident to those skilled in the art on how to provide such a caming mechanism if intermittent cuts or reflecting surfaces are desired on a continuous cylindrical external surface.

If a greater number of reflective surfaces are desired without exceeding a certain linear velocity of advancement of the item to be treated through the cutting tool 10 or without exceeding relative angular velocities or rotation, as described, it is possible to increase the number of cutting tips or elements 32 which project into the cutting station bore 26. Here, six cutting tips 32 project radially inwardly so that for a given combination of linear velocity of the chain and an angular velocity of the cutting tool 10, at least three times as many grooves or reflecting surfaces will be imparted with the arrangement shown in FIG. 6. The effectiveness of this approach can, clearly, be modified by varying the number of cutting tips which project into the central bore 26.

In operation the chain is moved longitudinally along its axis A through the die opening 26 when the die 10 is rotated at a pre-selected speed in accordance with the presently preferred embodiment. With the rotation of the die, the cutting ends or tips 32 of the cutting elements 32 traverse a generally circular path which extends radially inwardly of the cylindrical surface which forms the outer surface 12*s* of the item of jewelry. The resulting interference between the cutting tips 32 and the jewelry surface 12*s* causes the cutting tips to cut, scrape or scratch the surface 12*s* of the item of jewelry. The cuts 38 are in the nature of nicks, scratches, scrapes which, as suggested, can be relatively minor or more pronounced, as desired. These markings on the surface, however, nevertheless form relatively small reflective surfaces that serve to reflect light and, therefore, each of these nicks, scrapes or scratches efficiently become separate small mirror or reflecting surfaces that produce a sparkling effect substantially about the entire cylindrical surface of the item of jewelry. What is equally important to note is that because the cuts are imparted by relative rotation between the die and the item of jewelry, such as rope chain, this does not result in a radical or significant change in the general external shape or cross section of the item of jewelry whose surface is being modified. The rope chain retains a generally cylindrical overall shape, unlike with prior art techniques, and yet provides adequate reflecting surfaces that match and/or exceed the number of reflective surfaces on the diamond cut product.

If is also important to note that the process of the present invention can be applied to both solid and hollow chains or tubes as well as hollow ones since the process does not involve compression of elongate cylindrical tubular member, but rather, merely uses a sweeping motion of a cutting tip or tips along the circumferential or outer cylindrical surface relative to the surface being modified. For that same reason the method can be used for any chains or tubes whether their outer surface is circular, square, triangular, etc.

While the preferred process entails the use of diamond cut tips, it is clear that other cutting methods may be employed to achieve the same result. Thus, hardened steel cutting tips can be used, particularly considering that the process would most normally be applied to gold and silver jewelry which are generally soft metals and can be readily cut by hardened steel blades. Also, a continuous or pulsed laser beam may be used to remove portions of the surface, in which either the chain or the beam moves in relation to the other.

It is possible, with the method of the invention, to employ one or more rotating dies, along successive axial portions of the elongate jewelry item, such as a rope chain and these can rotate at the same or different speeds. Additionally, each rotating dye can also carry more than one cutting tip, as aforementioned, and any desired number of cutting tips may be employed. Different ones of the dies may employ different numbers of tips, to provide much flexibility or versatility in the apparatus and method in producing extensive combinations or reflecting surfaces.

Different effects can also be obtained by varying the angles of the cutting tips or elements in relation to the longitudinal direction of the advancing tubular member or chain. Thus, the cutting elements may be directed radially inwardly or may be oriented at angles relative to the radial direction. A specific angular orientation and/or relative position of two or more cutting tips will be selected on the basis of the overall general "spotting" pattern that is desired.

As suggested, the item of jewelry can be cut by imparting very minor surface marks or more substantial and deeper cuts can be imparted. Particularly when deeper cuts are imparted to the item of jewelry, some of the material at the surface will be removed. It is contemplated that the amount of material that can be removed can be anywhere within a range of 0–30% by weight. Again, the specific amount of material removed will be a function of the look or design appearance that is desired to be achieved.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

I claim:

1. Method of imparting reflective surfaces to the surface of an elongate item of jewelry having an external surface defining a longitudinal jewelry axis, the method comprising the steps for advancing while substantially freely suspended successive portions of the item of jewelry to generally position the jewelry axis associated with each portion along an axis of a station at which reflecting surfaces are to be imparted to the portion of the item of jewelry; providing surface modifying means along said station axis for imparting reflecting surfaces on the external surface of the portion of the item of jewelry at the station when rotating about said jewelry axis relative to the substantially freely suspended jewelry portion; and imparting relative rotation between said portion at the station and said surface modifying means to provide reflective surfaces about the circumferential extent of said surface as the item of jewelry is advanced substantially unsupported by any fixed or rigid support structure at the station at which the reflecting surfaces are imparted.

2. Method as defined in claim 1, wherein the jewelry is advanced linearly along the jewelry axis, and rotating said surface modifying means about said station axis to provide said relative rotation.

3. Method as defined in claim 1, wherein said surface modifying means imparts reflective surfaces by cutting grooves in said external surface.

4. Method as defined in claim 3, wherein at least one groove is cut at any given time in said external surface.

5. Method as defined in claim 4, wherein a plurality of grooves are cut simultaneously in said external surface.

6. Method as defined in claim 1, wherein said surface modifying means imparts reflective surfaces by cutting grooves each of which includes at least one flat reflective surface in said external surface.

7. Method as defined in claim 1, wherein material separated from the jewelry portion during formation of reflecting surface is removed.

8. Method as defined in claim 1, wherein said surface modifying means imparts reflective surfaces by application of a blunt tool to said external surface.

9. Apparatus for imparting reflective surfaces tot he surface of an elongate item of jewelry having an external surface, defining a longitudinal jewelry axis, comprising advancing means for advancing while substantially freely suspended successive portions of the item of jewelry to generally position the jewelry axis associated with each portion along an axis of a station at which reflecting surfaces are to be imparted to the item of portion of the item of jewelry; surface modifying means along said station axis for imparting reflecting surfaces on the external surface of the portion of the item of jewelry at the station when rotating about said jewelry axis relative to the substantially freely suspended jewelry portion; and means for imparting relative rotation between the jewelry portion at the station and said surface modifying means to provide reflective surfaces about the circumferential extent of said surface as the item of jewelry is advanced substantially unsupported by any fixed or rigid support structure at the station at which the reflecting surfaces are imparted.

10. Apparatus as defined in claim 9, wherein said surface modifying means comprises a rotating die which rotates about said jewelry axis and which includes at least one cutting element which imparts grooves in the surface of the jewelry.

11. Apparatus as defined in claim 10, wherein said rotating die has a central bore through which the item of jewelry can linearly advance, and said at least one cutting element extends into said bore radially inwardly to penetrate said bore beyond the surface of the item of jewelry.

12. Apparatus as defined in claim 10, wherein said rotating die includes annular cylindrical member having an axial bore defining an inner cylindrical surface, and said surface modifying means comprises at least one radially inwardly projecting cutting element.

13. Apparatus as defined in claim 12, wherein a plurality of cutting elements are integrally formed on said inner cylindrical surface which are circumferentially spaced from each other about the axis of said bore.

14. Apparatus as defined in claim 13, wherein the spacing between adjacent ones of said cutting elements is substantially equal.

15. Apparatus as defined in claim 12, wherein said cutting elements are formed of hardened steel.

16. Apparatus as defined in claim 12, wherein said cutting elements are diamond cutting elements.

17. Apparatus as defined in claim 12, wherein said annular cylindrical member has at least one radial tool receiving bore extending through the entire radial thickness of said annular cylindrical member to communicate with said axial bore; an elongate cutting element radially adjustably positionable within said tool receiving bore and having a cutting tip extending into said axial bore; and fastening means to secure the radial position of said elongate cutting element in a desired cutting position.

18. Apparatus as defined in claim 17, wherein said fastening means comprises a locking screw threadably received within a threaded hole communicating with said tool receiving bore.

19. Apparatus as defined in claim 12, further comprising removing means for removing material separated from the item of jewelry during formation of the reflecting surfaces.

20. Apparatus as defined in claim 19, wherein said removing means comprises at least one radial discharge channel extending between the inner and outer surfaces of said annular cylindrical member to permit material formed within said axial bore.

* * * * *